US012498117B2

(12) United States Patent
Said et al.

(10) Patent No.: US 12,498,117 B2
(45) Date of Patent: Dec. 16, 2025

(54) BURNER AND COMBUSTION METHOD FOR A BURNER

(71) Applicant: FIVES PILLARD, Marseilles (FR)

(72) Inventors: Fouad Said, Marseilles (FR); Pascal Laroche, Marseilles (FR)

(73) Assignee: FIVES PILLARD, Marseilles (FR)

( * ) Notice: Subject to any disclaimer, the term of this patent is extended or adjusted under 35 U.S.C. 154(b) by 454 days.

(21) Appl. No.: 17/282,992

(22) PCT Filed: Oct. 5, 2018

(86) PCT No.: PCT/FR2018/052461
§ 371 (c)(1),
(2) Date: Apr. 5, 2021

(87) PCT Pub. No.: WO2019/008304
PCT Pub. Date: Jan. 10, 2019

(65) Prior Publication Data
US 2021/0341142 A1 Nov. 4, 2021

(51) Int. Cl.

| | |
|---|---|
| ***F23D 14/70*** | (2006.01) |
| ***F23D 14/48*** | (2006.01) |
| ***F23R 3/20*** | (2006.01) |
| ***F23R 3/28*** | (2006.01) |

(52) U.S. Cl.
CPC ..... *F23D 14/70* (2013.01); *F23D 14/48* (2013.01); *F23R 3/20* (2013.01); *F23R 3/286* (2013.01); *F23D 2900/00008* (2013.01)

(58) Field of Classification Search
CPC .. F23R 3/20; F23R 3/286; F23D 14/70; F23D 14/48; F02C 1/08; F02C 3/34
See application file for complete search history.

(56) References Cited

U.S. PATENT DOCUMENTS 3,270,506 A * 9/1966 Bahr ..... F23R 3/20 60/749
4,589,260 A 5/1986 Krockow
4,967,561 A * 11/1990 Bruhwiler ..... F23R 3/36 60/737
5,263,325 A 11/1993 McVey et al.
(Continued)

FOREIGN PATENT DOCUMENTS

FR 3004239 10/2014

OTHER PUBLICATIONS

International Search Report and Written Opinion for International Application No. PCT/FR2018/052461 date mailed Jun. 14, 2019.

*Primary Examiner* — Andrew H Nguyen
(74) *Attorney, Agent, or Firm* — Conley Rose, P.C.

(57) ABSTRACT

A burner designed to be fitted in a combustion chamber, the burner including:

a central nozzle configured to have an oxidizer and fuel supply;

several peripheral nozzles configured to have an oxidizer and fuel supply and which each have at least one upstream fuel injector in order to pre-mix the fuel and the oxidizer in the nozzle;

at least one oxidizer input connected to the said central and/or peripheral nozzles;

wherein peripheral nozzles each have a flame stabilizer located at the end of the peripheral nozzle designed to exit into the combustion chamber, as well as a tip injector to inject fuel at the end of the peripheral nozzle.

8 Claims, 3 Drawing Sheets

(56) References Cited

U.S. PATENT DOCUMENTS

| | | | | |
|---|---|---|---|---|
| 5,471,840 | A * | 12/1995 | Lovett | F23D 14/70 60/737 |
| 6,446,439 | B1 * | 9/2002 | Kraft | F23R 3/286 60/746 |
| 2006/0029894 | A1 * | 2/2006 | Zinn | F23R 3/42 431/243 |
| 2014/0053528 | A1 * | 2/2014 | Crothers | F23R 3/18 60/39.37 |
| 2017/0082291 | A1 * | 3/2017 | Horikawa | F23R 3/002 |
| 2019/0242581 | A1 * | 8/2019 | Abe | F23R 3/18 |

* cited by examiner

BURNER AND COMBUSTION METHOD FOR A BURNER

The present application is a National Phase entry of PCT Application No. PCT/FR2018/052461, filed Oct. 5, 2018 which is hereby fully incorporated herein by reference.

TECHNICAL FIELD

This invention concerns a burner and the combustion technique for the burner.

More particularly, the burner is a premix gas burner intended for industrial applications such as boilers, hot gas generators, etc. This type of burner is usually mounted in a combustion chamber in which the flame is generated.

BACKGROUND

During combustion, burners release nitrogen oxides, referred to as $NO_x$ in this document, which are an unwanted result of combustion as they are considered to be pollutants that are harmful to health and the environment.

As a result, different countries or states are imposing increasingly drastic standards and regulations on acceptable $NO_x$ levels released by burners.

For example, in the case of "package boilers", environmental regulations categorize them depending on the amount of $NO_x$ released, levels are referred to as:

- Standard $NO_x$ if the level of released $NO_x$ is less than 60 ppm (parts per million);
- Low $NO_x$ if the level of released $NO_x$ is less than 30 ppm;
- Ultra-Low $NO_x$ if the level of released $NO_x$ is less than 10 ppm (for example, this is a requirement in California, Texas, Louisiana, New Jersey . . . ).

It should be noted that a "package" boiler for example, is an industrial boiler of sufficiently reduced dimensions that its' transport (usually using a standard truck) and installation are made easier. As a result, this type of boiler has a combustion chamber of which the volume and/or diameter are smaller than for a classic boiler.

Nevertheless, the reduced size of the combustion chamber makes it difficult to obtain a stable flame that produces lower amounts of nitrogen oxides.

SUMMARY

Thus, the applicant was able to see that on this type of application, the quantity of $NO_x$ formed during combustion especially depends on physical units as mentioned below and illustrated in FIG. 1.

FIGS. 1*a*, 1*b*, 2*a* et 2*b* are very schematic lengthways or transverse cross section views of a burner 1 fitted to a combustion chamber 3 or 3'.

Burner 1 has a central nozzle 5 and many peripheral nozzles 7 placed in almost circular layout around nozzle 5. Furthermore, burner 1 has an apparent diameter of $\varphi_B$ and a peripheral injection diameter of $\varphi_P$.

The burner's apparent diameter $\varphi_B$ is the diameter actually occupied by the burner's flame or flames in combustion chamber 3 (this is almost the working cross section seen by the flame).

The peripheral injection diameter $\varphi_P$ is the distance between two opposite peripheral nozzles 7, i.e. the straight line connecting the centre of two peripheral nozzles 7 that passes through the middle of the central nozzle 5.

As for combustion chamber 3, it has an equivalent diameter $\varphi_E$ which is the working diameter in which the energy generated by burner 1 can spread (this is the working surface area of the combustion chamber in the combustion process).

Thus, when burner 1 is running, it generates a total power noted $P_B$, the total power $P_B$ being a so-called central power $P_C$ Generated by the Central nozzle 5 and a so-called peripheral power $P_P$ generated by the peripheral nozzles 7.

Burner 1 can therefore be characterized by at least the following physical units:

- the volume load $C_v$ (expressed in $kW/m^3$ or $kJ/s/m^3$) which is the amount of energy provided by time unit by burner 1 over the volume V of combustion chamber 3, i.e. $C_v=P_B/V$;
- the transverse surface area load $C_{st}$ (expressed in $kW/m^2$ or in $kJ/s/m^2$) which is the amount of energy per time unit provided by burner 1, i.e. $P_B$ over the transverse cross section $S_T$ of combustion chamber 3, hence $C_{st}=P_B/S_T$ (the transverse cross section $S_T$ is the surface area defined by the circle with a diameter of $\varphi_E$);
- the surface density of peripheral power $D_p$ (expressed in $kW/m^2$ or in $kJ/s/m^2$) which corresponds to the quantity of peripheral energy per time unit provided by the peripheral nozzles 7 of burner 1, or $P_p$ over the transverse cross section of the combustion chamber in which the peripheral power is produced, hence:

$$D_P=P_P/(\varphi_E^2-\varphi_P^2)$$

The Applicant was therefore able to find that in combustion chambers of restricted dimensions, the quantity of $NO_x$ that is formed is directly proportional to the surface density of peripheral power $D_P$. For a given burner power, the smaller the combustion chamber, the more the surface density of the peripheral power $D_P$ increases and the higher the quantity of generated $NO_x$.

Several technical solutions are known to reduce the quantity of $NO_x$ released during combustion, such as:

- Internal combustion gas circulation. Indeed, when the combustion chamber dimensions allow it, the peripheral power $P_P$, by the intermediary of the fuel jet impulsion, induces internal combustion gas recirculation phenomena that make it possible to locally lower the flame temperature and thereby reduce the quantity of $NO_x$ formed.

These combustion gas recirculation phenomena, referenced $R_f$ and $R_f'$, are more especially illustrated in FIGS. 2*a* and 2*b* which both show a burner similar to the one in FIG. 1. The same references are used below to indicate similar elements.

Thus, the only difference there is between the burner 1—combustion chamber 3 unit in FIG. 2*a*, and the burner 1'-combustion chamber 3' unit in FIG. 2*b* is that combustion chamber 3' is smaller in size than combustion chamber 3, burners 1 and 1' being identical.

We thus find that the reduction in the dimensions of combustion chamber 3' reduces the quantity of internal combustion gases that can recirculate to allow a drop in the flame temperature generated by burner 1'.

Furthermore, in the case of combustion chambers of a reduced dimension, the peripheral power surface density $D_P$ increases. This, combined with the fact that the internal combustion gas recirculation drops or even stops altogether (FIG. 2*b*), results in a significant increase in the amount of $NO_x$ that is formed.

- The staging of the fuel, consisting in injecting the fuel into the burner in a fractioned manner to lead to the creation of different combustion zones which make it possible to reduce the $NO_x$ that has already formed.

Thus, in the so-called primary combustion zone, i.e. at central nozzle 5, combustion occurs in excess air conditions leading to the formation of thermal $NO_x$. $NO_x$ is referred to as thermal when formed by the chemical combination of oxygen and nitrogen in the air during a very high temperature combustion (usually in excess of 1500° C.).

Whereas, in the so-called secondary combustion zone, or re-combustion zone, i.e. around the peripheral nozzles, the fuel (here gas) is injected into the combustion gases from the primary combustion zone. This reducing atmosphere leads to a reduction in the previously formed $NO_x$. Indeed, the hydrocarbon radicals ($CH_i$) produced in this atmosphere reduce the thermal $NO_x$ into $N_2$.

However, the efficiency of this technical solution mainly depends on the distribution of the central power $P_C$ and peripheral power $P_P$, as well as on the peripheral injection diameter $\varphi_P$.

Thus, the quantity of $NO_x$ that is formed drops, when the power is transferred from the centre of the burner to the periphery increases and/or when the diameter of the peripheral injection $\varphi_P$ increases.

Internal combustion gas recirculation technical solutions and fuel staging are often combined to optimise the quantity of $NO_x$ generated by a burner.

It should also be noted that it is important that:

- the combustion chamber/burner unit assembly be simple,
- that the flows of oxidizers and/or fuel be easy to modulate when the burner is operating,
- the combustion flame be stable, and/or
- the flame diameter and length be adjustable in order to prevent impacts on the side walls and/or the bottom of the combustion chamber.

Unfortunately, for reduced size combustion chambers, the use and implementation of these techniques are limited. Indeed, internal combustion gas recirculation or fuel staging techniques are only effective if the combustion chamber diameter is sufficiently big. Furthermore, since the peripheral injection diameter is limited by the diameter of the combustion chamber and because there is an increase in the peripheral power (which leads to an increase in the surface density of the peripheral power), there is an increase in the quantity of $NO_x$ formed during combustion.

Nevertheless, one can also highlight the fact that in the case of combustion chambers that are too narrow, there are secondary $NO_x$ reduction techniques, such as:

- the injection of urea solution into the fumes, a technique also known as "SNCR" ("Selective Non-Catalytic Reduction"), this technique has the disadvantage of being very expensive as it requires constant monitoring and maintenance.
- External combustion gas recirculation, also known as "FGR" ("Flue Gas Recirculation"), which consists in recovering part of the combustion gases and re-injecting it at the burner's oxidizer input (the oxidiser then becomes a mix of oxidizer-combustion gas, the oxidiser being air for example).

Thus an FGR percentage is defined, referenced as $\%_{FGR}$, by the ratio of recycled combustion gas flow $Q_{FGR}$ over the combustion oxidizer flow $C_{ombe}$ entering the burner (each flow normally being expressed in Nm3/h for normal-metres cubed per hour), or:

$$\%_{FGR}=Q_{FGR}/(Q_{comb}+Q_{FGR})$$

Conventional low $NO_x$ emission burners can operate with a maximum FGR percentage of 15%, beyond 15%, the significant depletion of the oxidizer (air in this example) $O_2$ content no longer makes it possible to guarantee a stable and safe combustion.

Thus, an industrial burner that can operate with high GFR percentages (i.e. between 20 and 35%) adapted to reduced size combustion chambers is a major economic stake.

Therefore, this invention aims to remedy at least one of the disadvantages mentioned above and to propose a new type of burner and a combustion process associated with the burner.

Thus, embodiments of the invention concern a burner designed to be fitted in a combustion chamber, the burner having at least:

- a central nozzle configured to have an oxidizer and fuel supply;
- several peripheral nozzles configured to have an oxidizer and fuel supply and which each have at least one upstream fuel injector in order to pre-mix the fuel and the oxidizer in the nozzle;
- at least one oxidizer input connected to the central and/or peripheral nozzles;
- characterized in that the peripheral nozzles each have a flame stabilizer located at the end of the peripheral nozzle designed to exit in the combustion chamber, as well and an end injector to inject fuel at the end of the peripheral nozzle.

The burner's specific structure using this invention in particular makes it possible to obtain the combustion of the fuel, such as a gas, with an $NO_x$ emission of less than 10 ppm, for the use of the burner in reduced size combustion chambers.

Furthermore, the burner structure in particular makes it possible to control:

- the flame size (for example its diameter) and to thereby limit the impacts of the flame on the combustion chamber walls;
- the CO (carbon monoxide) emissions by reducing or eliminating the volume of peripheral flame;
- when the oxidizer is air, the excess residual air by reducing the oxygen level in the oxidizer.

Furthermore, the addition of fuel injectors at the end of the burner allows the local enrichment of the pre-mix at the exit of the peripheral nozzle, locally increasing the flame temperature to encourage its latching.

One can note that, in general, a burner has an end in which the fuel and the oxidizer are transported by nozzles and in which a combustion reaction occurs, i.e. a zone that can also be referred to as a burner tip. This is usually the zone located immediately downstream of the nozzles. One can also define a tip for each nozzle, with all the tips defining the combustion end or the burner tip.

In one possible embodiment, the burner includes a fuel supply.

In another possible embodiment, the burner is a gas burner with pre-mixing.

In another possible embodiment, the burner is intended to burn various gases, such as methane, propane, biogas, etc.

In another possible embodiment, the burner has a main axis.

The main axis is usually a straight line passing through the centre of the burner and parallel to the burner's largest dimension. The main axis can also be merged with the burner's rotating axis.

In another possible embodiment, each nozzle, whether central or peripheral, has a longitudinal axis parallel to the burner's main axis.

One can also note that a nozzle, whether central or peripheral, includes:

a flow flue in which fuel, oxidizer or a fuel-oxidizer mix can flow;

one or several oxidizer, fuel or fuel-oxidizer mix injectors.

In another possible embodiment, the flame stabilizer has a surface area of between 40 and 70% of the associated peripheral nozzle cross section, and preferably a surface area between 50 and 70% (the peripheral nozzle cross section can be identified in particular by the cross section of the nozzle flue).

This specific surface area interval in particular makes it possible to improve the pre-mix in the peripheral nozzles, but also to obtain a more linear gas speed profile (i.e. gas speed variations between the centre and periphery of the nozzle are reduced).

In another possible embodiment, the flame stabilizer has a central part placed at the centre of the peripheral nozzle, it is the surface area of the central part that must have a surface area included between 40 and 70%, or preferably between 50 and 70% of the nozzle cross section.

In another possible embodiment, the flame stabilizer is connected to the burner structure by an intermediate part supporting the central part at the centre of the peripheral nozzle.

In another possible embodiment, the central nozzle has a central injector configured to inject fuel, characterized such that the injector has radial injection openings that are orthogonal to the burner's main axis.

In another possible embodiment, the central nozzle has an oxidizer nozzle which has oxidizer injector openings that are straight and almost parallel to the burner's main axis.

More particularly, the fact that the oxidizer injection openings are straight, thus preventing the injected oxidizer from rotating around the burner's main axis. This leads to a drop in the quantity of $NO_x$ formed despite the fact that the oxidizer injected by the central nozzle is only a small percentage of the oxidizer used in the burner.

Thus, the fuel-oxidizer injections are orthogonal compared to each other in the burner's central nozzle, leading, amongst other things, to better flame latching.

In another possible embodiment, the burner has injection lances configured to inject fuel into the periphery of the central nozzle and/or the peripheral nozzles.

The embodiments of the invention also concern a burner combustion process, such as defined above, configured to burn fuel flowing through the burner at a total flow rate of $Q_T$, and in which the central nozzle is configured to deliver a fuel flow C, all the upstream injectors are configured to deliver a fuel flow P, all the tip injectors are configured to deliver a fuel flow S, the fuel flow P representing at the maximum 85% of the total fuel flow $Q_T$, the fuel flow C representing at the maximum 10% of the total fuel flow $Q_T$, the fuel flow S representing at the maximum 15% of the total fuel flow $Q_T$.

The specific burner fuel intervals make it possible to minimize the formation of $NO_x$ generated by the burner while allowing a stable combustion flame to be formed in combustion chambers of reduced dimensions.

In a possible embodiment of the process, the fuel flow P represents at least 70% of the total fuel flow $Q_T$, the C fuel flow represents at least 5% of the total fuel flow $Q_T$.

In another possible embodiment, the fuel flow S represents at least 1% of the total fuel flow $Q_T$.

In another possible embodiment of the process, all the injection lances deliver a fuel flow G representing at the maximum 20% of the total fuel flow $Q_T$.

Preferably, the fuel flow G represents at the maximum 10% of the total fuel flow $Q_T$.

In another possible embodiment of the process, the oxidizer includes a maximum of 35% of combustion gases (or a $\%_{FGR}$ less than or equal to 35%).

BRIEF DESCRIPTION OF THE DRAWINGS

The invention will be better understood and other purposes, details, characteristics, and advantages of the invention will appear more clearly on reading the following description given by way of an illustrating and non-limiting example and with reference to the accompanying drawings, in which.

DETAILED DESCRIPTION

Figure 1A:
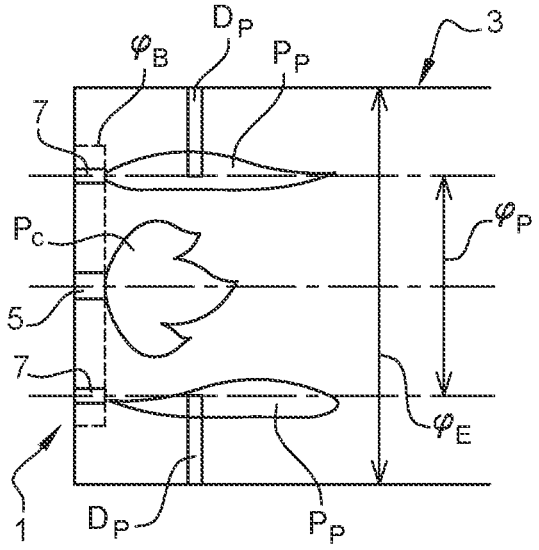
FIGS. 1*a*, 1*b*, 2*a* and 2*b* are schematic cross sectional views of a burner fitted to a combustion chamber according to an embodiment of the invention.
Figure 1B:
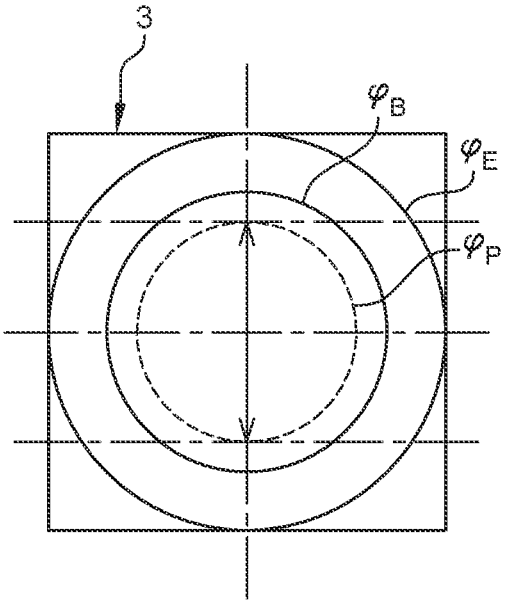
Figure 2A:
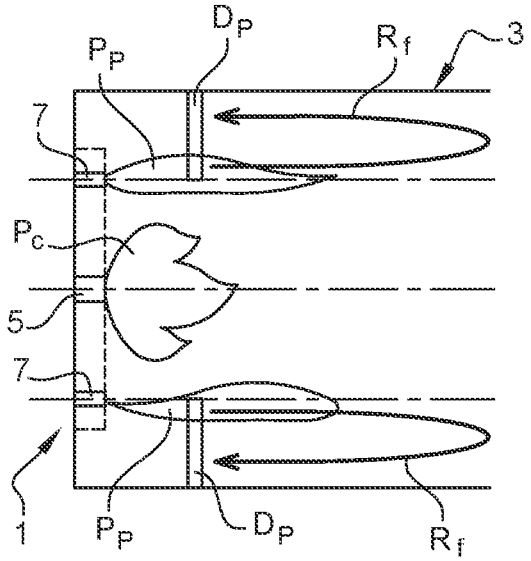
Figure 2B:
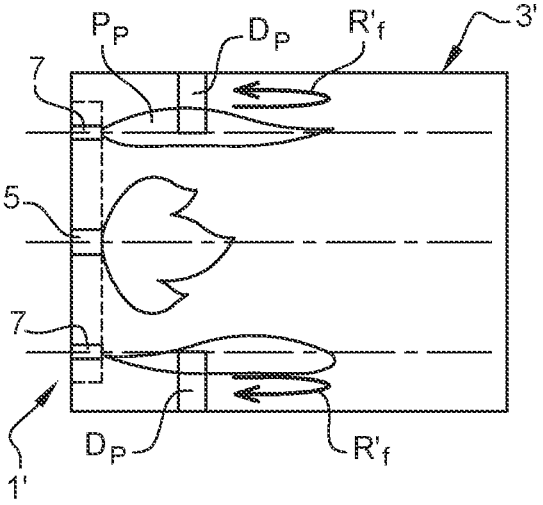
Figure 3:
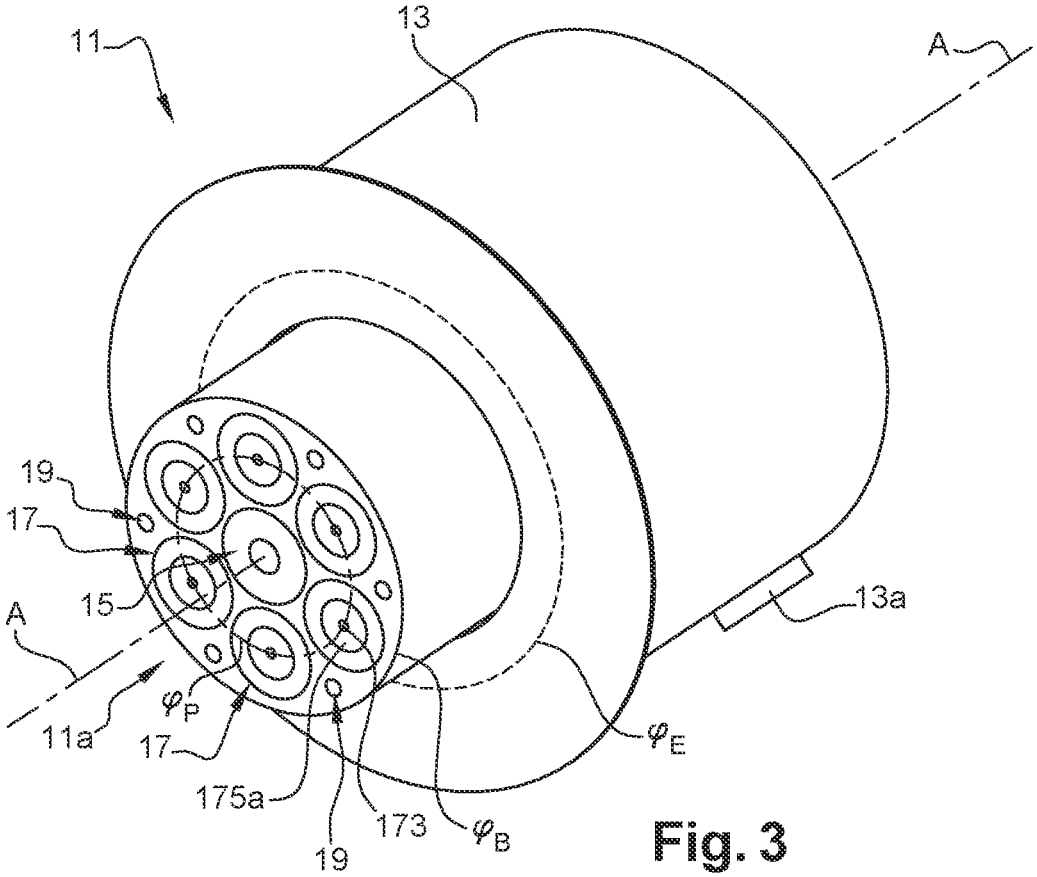
FIG. 3 a perspective schematic view of a burner according to the invention.

FIG. 3 is a schematic representation of a burner 11 according to the invention designed to be fitted in a combustion chamber with reduced dimensions for example.

Burner 11 has a main body 13, for example of an almost cylindrical shape, in which an oxidizer input 13*a* is created. Oxidizer input 13*a* also generally includes a regulation device, such as a flap, to regulate the quantity of oxidizer entering the main body 13. In this example, the oxidizer used is air, but any oxidizer that allows combustion can be used.

Burner 11 also includes a fuel supply resource (not shown on FIG. 3), in particular a gas supply, such as methane propane, as well as one or more nozzles 15 and 17. More particularly, burner 11 has a central nozzle 15 and so-called peripheral nozzles 17 arranged around central nozzle 15.

Central nozzle 15 is designed to create a radial flame, whereas the peripheral nozzles 17 are designed to create mainly axial flames. The radial flame created by central nozzle 15 is also intended to provide at least part of the ignition between the peripheral nozzles 17.

Generally, the peripheral nozzles 17 are arranged circularly around the central nozzle 15 according to a diameter $\varphi_P$, the diameter $\varphi_P$ being identified by the peripheral injection diameter described previously.

One can also note that the different burner nozzles have at least one flow flue, as well as one or more oxidizer injectors, fuel injectors or oxidizer/fuel injectors.

Thus, the flow flue has an end part connected to oxidizer input 13*a*, and a second end coming out in a zone in which the combustion occurs and in which the flame is generated.

More particularly, all the nozzles, central 15 and peripheral 17 lead to a tip 11*a* designed to exit into the combustion chamber when the burner is in the fitted position, a zone also known as the burner tip. This tip or zone is the place where combustion occurs (it is a zone in which the fuel and oxidizer that have been brought by the different nozzles will come together in order to generate a combustion reaction). A tip (or nose) can also be defined for each nozzle 15 and 17, all the nozzle ends defining the burner tip 11*a*.

Burner 11 has a main axis A (or central), which is, for example, the rotating axis of the central nozzle 15 (it can also be the burner's rotating axis). Each peripheral nozzle 17 rotating axis is in a circle of diameter $\varphi_P$, of which the centre is part of the central axis A.

Furthermore, in the shown embodiment, burner 11 has fuel injection lances 19 arranged on the periphery, towards the outside, of the peripheral nozzles 17.

The fuel lances 19 are preferably arranged in a circular manner, between or around the peripheral nozzles 17. One can however note that the presence of injection lances in the burner is only an option in an embodiment of the invention and that the injection lances 19 are not required for the burner 11 to operate properly.

On can thus define a circle of diameter $\varphi_B$ in which the central nozzle 15, the peripheral nozzles 17 and the injection lances 19, when burner 11 has them, are to be found, the diameter $\varphi_B$ being the burner 11 diameter (detailed previously).

Furthermore, when burner 11 is fitted in a combustion chamber, the combustion chamber is over the diameter $\varphi_B$ circle. One can then define an equivalent combustion chamber diameter $\varphi_E$ corresponding to a circle inside the combustion chamber walls and which encircles the diameter $\varphi_B$ circle.

One can thus see, more particularly visible in FIG. 3, that the central nozzle 15 is in two parts:

- a central fuel injector 151 configured to radially inject fuel into a combustion chamber (radially relative to the main axis A of the central nozzle 15);
- an oxidizer injector 153 surrounding the central injector 151.

The central injector 151 protrudes, is of an almost cylindrical shape, and has several openings 157.

Figure 4:
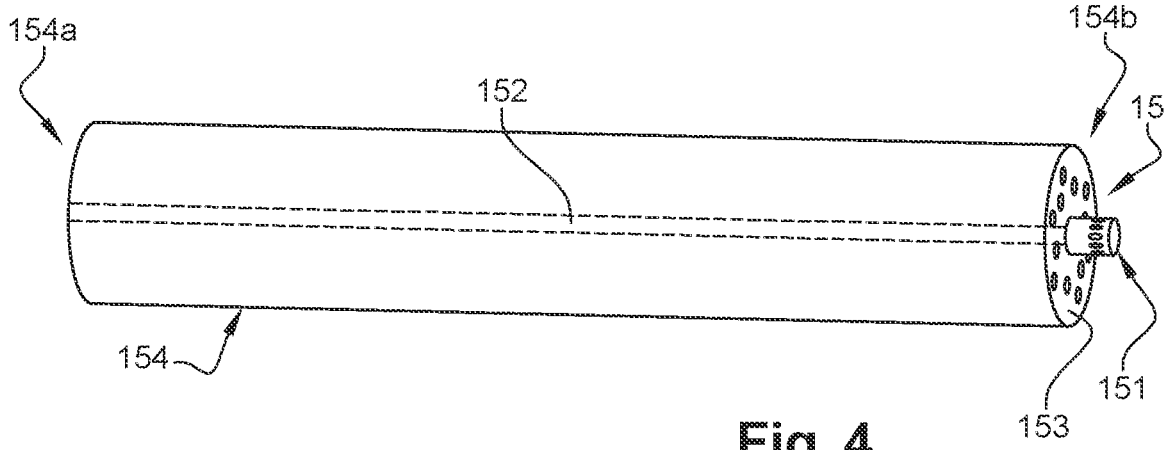
FIGS. 4 to 6 are highly schematic transverse and longitudinal cross section views of burners from FIG. 3.

FIG. 4 is a schematic longitudinal cross section view of the central nozzle 15 of the burner in FIG. 3.

The central nozzle 15 has a flow flue 154 that has a first 154*a* and second 154*b* end, as well as a fuel supply flue 152 connecting the terminal part of the central injector 151 to a fuel source.

The first end 154*a* of the central nozzle 15 is connected to the oxidizer input 13*a* in order to allow the oxidizer to circulate inside the flue 154. The second end 154*b* leads to the tip 11*a* of the burner when the burner is fitted in the combustion chamber.

Figure 5A:
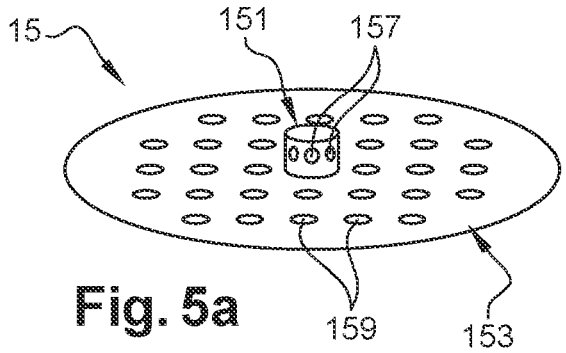
Figure 5B:
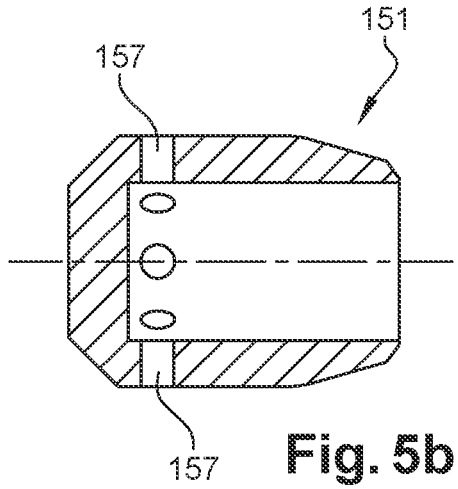
Figure 5C:
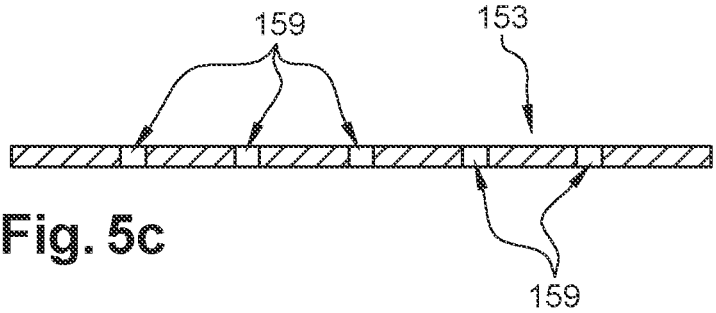

The details of the terminal part, i.e. the part located near the combustion tip 11*a* of burner 11, of the central nozzle 15 are shown in FIGS. 5*a* to 5*c* and will be detailed below using these figures.

Thus, FIGS. 5*a* to 5*c* are very schematic views of the central injector 151, respectively in transverse and longitudinal cross sections. The openings 157 are radial, arranged circularly around main axis A (which is also the rotating axis of central nozzle 15) and oriented orthogonally to the main axis A of burner 11.

The oxidizer injector 153 has several openings 159 mainly oriented along main axis A (i.e. the normal at the passage cross section of opening 159 is almost parallel to main axis A).

Openings 157 and 159 respectively of the central injector 151 and the oxidizer injector 153 are preferably straight.

Figure 6:
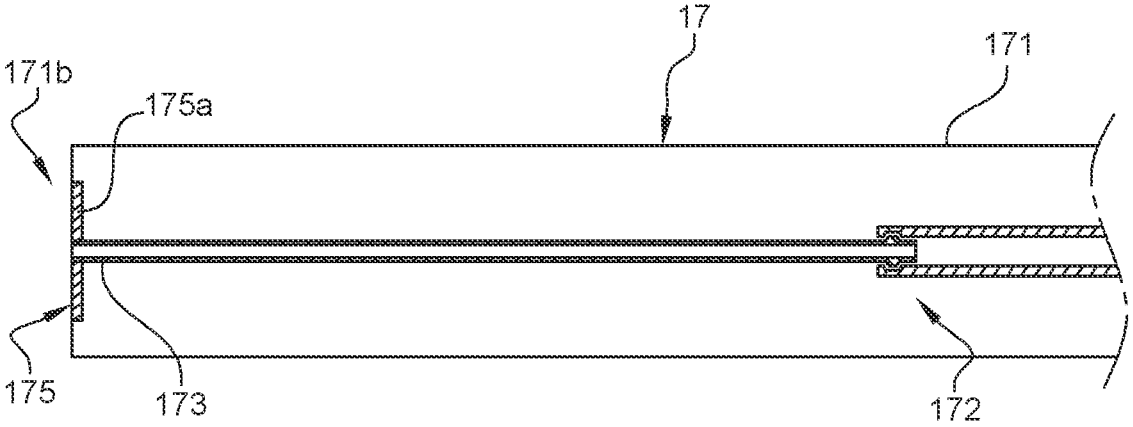

As for FIG. 6, it is a highly schematic view of a longitudinal cross section of a peripheral nozzle 17.

As explained previously, peripheral nozzle 17 has a flow flue 171 that has a first and second tip 171*b*, as well as two fuel injectors respectively referred to as upstream (or pre-mix) 172 and tip 173.

The first end of peripheral nozzle 17 is connected to the oxidizer input 13*a* in order to allow the oxidizer to circulate inside the flue 171. The second tip 171*b* leads to the burner combustion tip 11*a*.

The upstream injector 172 is placed in flow flue 171 and is configured to inject fuel so that it mixes with the oxidizer, there is therefore a fuel-oxidizer pre-mix that occurs in peripheral nozzle 17. The pre-mix occurs in the time needed for the fuel to reach the second tip 171*b*.

Amongst other things, the peripheral nozzle 17 has a flame stabilizer 175. The flame stabilizer 175, usually placed at the second tip 171*b*, has a central part 175*a* placed at the centre of peripheral nozzle 17, more particularly at the centre of the flow flue 171.

The tip injector 173 is configured to inject fuel at the peripheral nozzle 17 tip, which also corresponds to the burner tip 11*a*. More particularly, the tip injector 173 leads to the flame stabilizer 175, for example by passing through its centre (which is also the centre of peripheral nozzle 17).

The upstream injector 172 and the tip injector 173 can be separate and independent fuel injectors, but can be, as in this embodiment, connected to each other, the tip injector 173 being connected fluidly to the upstream injector 172.

One can also note that the flame stabilizer 175 is held in the centre of peripheral nozzle 17 using the tip injector 173 (the injector 173 is used as a support for the stabilizer 175).

Thus, when burner 11 is operating, oxidizer enters through the oxidizer input 13*a* and circulates in the central nozzle 15 and the peripheral nozzles 17. The oxidizer comes out of the burner 11 through openings 159 of the oxidizer injector 153 and the peripheral nozzles 17, using the two tips 171*b* by passing around the flame stabilizers 175.

Furthermore, burner 11 delivers total a flow of fuel $Q_T$.

The central nozzle 15 delivers a fuel flow noted C, all the upstream injectors 172 for the peripheral nozzles 17 have a fuel flow noted P, all the tip injectors 173 for the peripheral nozzles 17 have a fuel flow noted S and all the peripheral lances 19 deliver a fuel flow noted G.

Thus, the total fuel flow $Q_T$ circulating through the burner 11 is the sum of the flows indicated above: C, P, S and G.

One will however note that the presence of the injection lances is optional and that if the burner has no injection lances, the total fuel flow $Q_T$ circulating through the burner 11 is the sum of flows C, P and S.

The combustion process according to the invention has at least:

- a fuel flow P of between 70 and 85% of the total fuel flow $Q_T$;
- a fuel flow C of between 5 and 10% of the total fuel flow $Q_T$;
- a fuel flow S of between 1 and 15% of the total fuel flow $Q_T$, and preferably between 7 and 15% of the total fuel flow $Q_T$.

Furthermore, when burner 11 has injection lances 19, all the injection lances deliver a fuel flow G which represents a maximum of 20% of total fuel flow $Q_T$, and preferably less than 10% of the total fuel flow $Q_T$.

Furthermore, the oxidizer used in the combustion process contains a maximum of 35% of combustion gases (i.e. a $\%_{FGR}$ less than or equal to 35%), and preferably between 20 and 35% of combustion gases (i.e. an $\%_{FGR}$ included between 20 and 35%).

The invention claimed is:

1. A burner for an industrial boiler or a hot gas generator designed to be fitted in a combustion chamber of reduced dimensions, the combustion chamber producing combustion gases, the burner having at least:

- a flue gas recirculation system that recovers part of the combustion gases;

a central nozzle having a first end and a second end, configured to be supplied in an oxidizer and in a fuel, and having a central injector and an oxidizer injector;

wherein the central injector comprises a first end and a second end, configured to inject fuel, the central injector comprising a flow flue that has a first end and a second end, as well as a fuel supply flue connecting the first end of the central injector to a fuel source, the second end of the central injector includes radial injection openings that are orthogonal to a burner's main axis (A) and leads to a burner combustion tip, and the oxidizer injector which at the first end of the central nozzle is connected to an oxidizer input in order to allow the oxidizer to circulate inside the flow flue of the central injector, and at the second end of the central nozzle the oxidizer injector has openings that are straight and almost parallel to the burner's main axis;

several peripheral nozzles configured to be supplied in oxidizer and in fuel, each peripheral nozzle has a flow flue that has a first tip and a second tip, as well as two fuel injectors defining at least one upstream fuel injector in order to pre-mix the fuel and the oxidizer in the peripheral nozzle, the first tip of each peripheral nozzle is connected to the oxidizer input in order to allow the oxidizer to circulate inside the flow flue of the peripheral nozzle, the second tip leads to the burner combustion tip, the at least one upstream fuel injector is placed in the flow flue of the peripheral nozzle and is configured to inject fuel so that the fuel mixes with the oxidizer, in the flow flue of the peripheral nozzle;

the peripheral nozzles each have a flame stabilizer located at an end of the peripheral nozzle at the second tip and placed at a center of the flow flue of the peripheral nozzle, as well as a tip injector to inject fuel at the second tip of the peripheral nozzle, the tip injector leading to and passing through a center of the flame stabilizer, the tip injector being connected fluidly to the at least one upstream injector;

the flame stabilizer has a surface area of between 40 and 70% of the associated peripheral nozzle's cross section; and, the oxidizer input coupled to the flue gas recirculation system and configured to inject an oxidizer mix comprising the oxidizer and between 20% to 35% of the combustion gases.

2. The burner as claimed in claim 1 including injection lances configured to inject fuel into a periphery of the central nozzle and/or the peripheral nozzles.

3. A combustion process for the burner according to claim 1, the burner is configured to burn a total flow of fuel noted $Q_T$ circulating through the burner and in which the central nozzle is configured to deliver a fuel flow C, all the upstream injectors are configured to deliver a fuel flow P, all the tip injectors are configured to deliver a fuel flow S, the fuel flow P representing at the maximum 85% of the total fuel flow $Q_T$, the fuel flow C representing at the maximum 10% of the total fuel flow $Q_T$, the fuel flow S representing at the maximum 15% of the total fuel flow $Q_T$.

4. The combustion process according to claim 3, wherein the fuel flow P represents at least 70% of the total fuel flow $Q_T$, the C fuel flow represents at least 5% of the total fuel flow $Q_T$.

5. The combustion process according to claim 3 wherein the fuel flow S represents at least 1% of the total fuel flow $Q_T$.

6. The combustion process according to claim 5 wherein injection lances deliver a fuel flow G representing at the maximum 20% of the total fuel flow $Q_T$.

7. An industrial boiler comprising the combustion chamber of reduced dimensions comprising a burner according to claim 1.

8. A hot gas generator comprising the combustion chamber of reduced dimensions comprising a burner according to claim 1.

* * * * *